US008540611B1

(12) United States Patent
Barr

(10) Patent No.: US 8,540,611 B1
(45) Date of Patent: Sep. 24, 2013

(54) FLEXIBLE ATTACHABLE EXERCISE DEVICE

(76) Inventor: David M. Barr, Golden, CO (US)

( * ) Notice: Subject to any disclaimer, the term of this patent is extended or adjusted under 35 U.S.C. 154(b) by 174 days.

(21) Appl. No.: 13/198,430

(22) Filed: Aug. 4, 2011

(51) Int. Cl.
*A63B 21/02* (2006.01)

(52) U.S. Cl.
USPC ..... 482/121; 482/129; 482/131

(58) Field of Classification Search
USPC ..... 482/23, 38–40, 91–96, 121, 131, 482/132, 139, 148; D21/662; 294/27.1, 294/67.1, 68.1, 154–157, 164, 165
See application file for complete search history.

(56) References Cited

U.S. PATENT DOCUMENTS 3,652,085 A 3/1972 Cole
4,417,726 A 11/1983 Schleis
4,529,240 A * 7/1985 Engel ..... 294/141
6,106,444 A 8/2000 Maingart
2005/0227827 A1 10/2005 Liester
2009/0156374 A1 * 6/2009 Miyahira ..... 482/106

* cited by examiner

*Primary Examiner* — Loan Thanh
*Assistant Examiner* — Nyca T Nguyen

(57) ABSTRACT

The flexible attachable exercise device provides extreme portability and also provides for anchoring to a variety of objects in order to provide stability and resistance. The u-shaped handle provides for close and spread grip. Comfort and easy grip are enhanced by handle rubber grips. The cross link provides best handle stability. The junction box is be separable. The chain loop is attached to the junction box by removable links. Both the chain loop and the coated cables are designed with rubberized coatings to prevent damage to objects they may be attached to. The coated cables employ sliding cinches to aid in object retention.

4 Claims, 6 Drawing Sheets

FLEXIBLE ATTACHABLE EXERCISE DEVICE

BACKGROUND OF THE INVENTION

A plethora of varied exercise devices have been presented. Typically, each has its own attraction. What has been needed is a basic and sturdy flexible attachable exercise device that can be affixed to stationary object or to weights so that an individual can perform various exercises that are substantially limited only by imagination.

FIELD OF THE INVENTION

The flexible attachable exercise device relates to exercise devices and more especially to a highly portable exercise device that can be attached to any of a variety of objects and also to weights.

SUMMARY OF THE INVENTION

The general purpose of the flexible attachable exercise device, described subsequently in greater detail, is to provide a flexible attachable exercise device which has many novel features that result in an improved flexible attachable exercise device which is not anticipated, rendered obvious, suggested, or even implied by prior art, either alone or in combination thereof.

To attain this, the flexible attachable exercise device provides extreme portability and also provides for anchoring to a variety of objects in order to provide stability and resistance. Weights may also be affixed to the chain loop and to the coated cables. The u-shaped handle provides for close and spread grip. Comfort and easy grip may be enhanced by handle rubber grips. The cross link may provide best handle stability. The junction box may be separable. The chain loop may be attached to the junction box by removable links. Both the chain loop and the coated cables are designed with rubberized coatings to prevent damage to objects they may be attached to. The coated cables may employ sliding cinches to aid in object retention.

Thus has been broadly outlined the more important features of the improved flexible attachable exercise device so that the detailed description thereof that follows may be better understood and in order that the present contribution to the art may be better appreciated.

An object of the flexible attachable exercise device is to be highly portable.

Another object of the flexible attachable exercise device is to attach to any of a variety of objects to provide both stability and resistance.

A further object of the flexible attachable exercise device is to be flexible.

An added object of the flexible attachable exercise device is to negate damage to objects attached to.

And, an object of the flexible attachable exercise device is to provide a comfortable grip.

These together with additional objects, features and advantages of the improved flexible attachable exercise device will be readily apparent to those of ordinary skill in the art upon reading the following detailed description of presently preferred, but nonetheless illustrative, embodiments of the improved flexible attachable exercise device when taken in conjunction with the accompanying drawings.

DETAILED DESCRIPTION OF THE DRAWINGS

With reference now to the drawings, and in particular FIGS. 1 through 7 thereof, the principles and concepts of the flexible attachable exercise device generally designated by the reference number 10 will be described.

Figure 2:
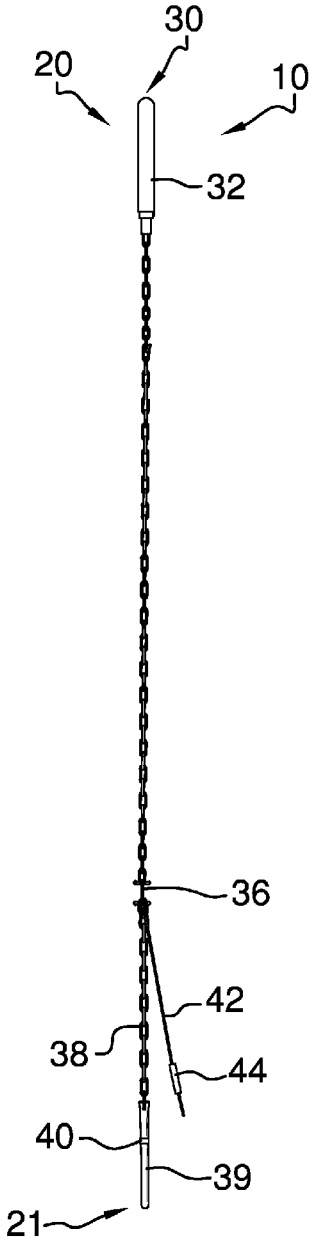
FIG. 2 is a lateral elevation view.

Referring to FIG. 2, the device 10 partially comprises a first end 20 spaced apart from a second end 21.

Figure 3:
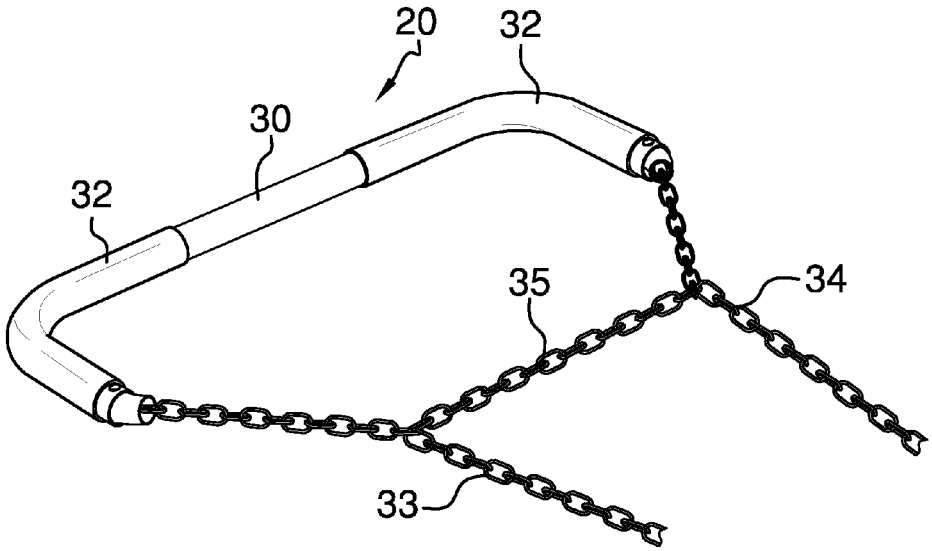
FIG. 3 is a perspective view of the first end with the handle affixed to the first and second chains, with cross link between the chains.

Referring to FIG. 3, the first end 20 partially comprises a u-shaped handle 30 with rubber grip 32.

Figure 1:
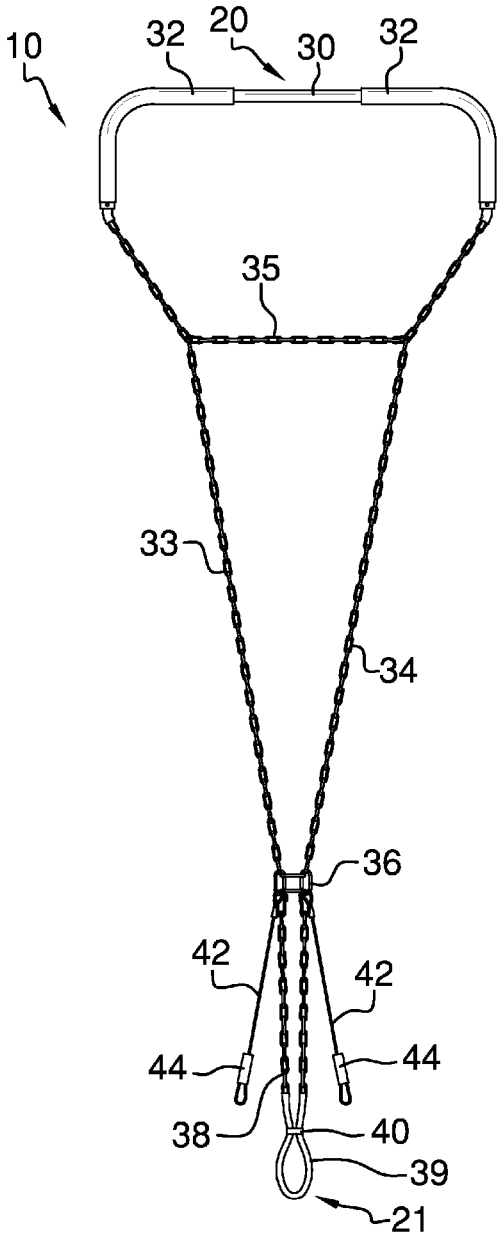
FIG. 1 is a top plan view.

Referring to FIG. 1, the first chain 33 is extended from a one side of a pair of opposite sides of the u-shaped handle 30. The second chain 34 is extended from a second side of the pair of opposite sides of the u-shaped handle 30. The cross link 35 connects the first chain 33 to the second chain 34 proximal to the u-shaped handle 30.

Figure 4:
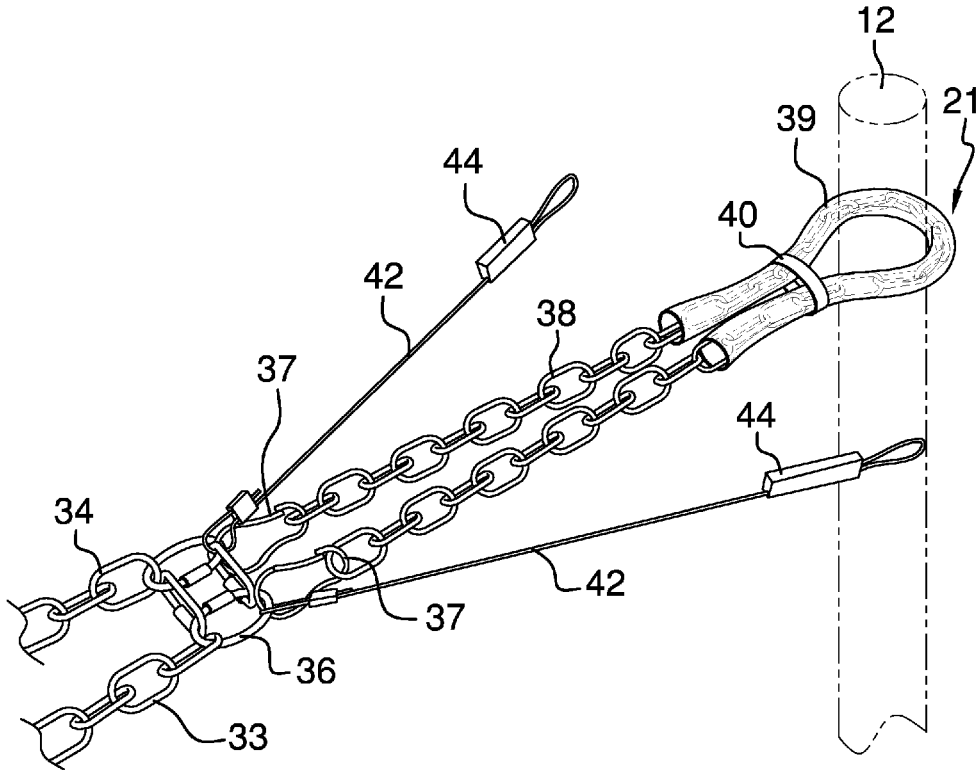
FIG. 4 is a perspective view of the second end.

Referring to FIG. 4, the separable junction box 36 connects the first chain 33 to the second chain 34 most proximal to the second end 21. The chain loop 38 is hooked to the junction box 36 via removable links 37. A rubberized cover 39 is disposed on the chain loop 38. The cinch 40 slideably binds the chain loop 38 to itself.

Figure 6:
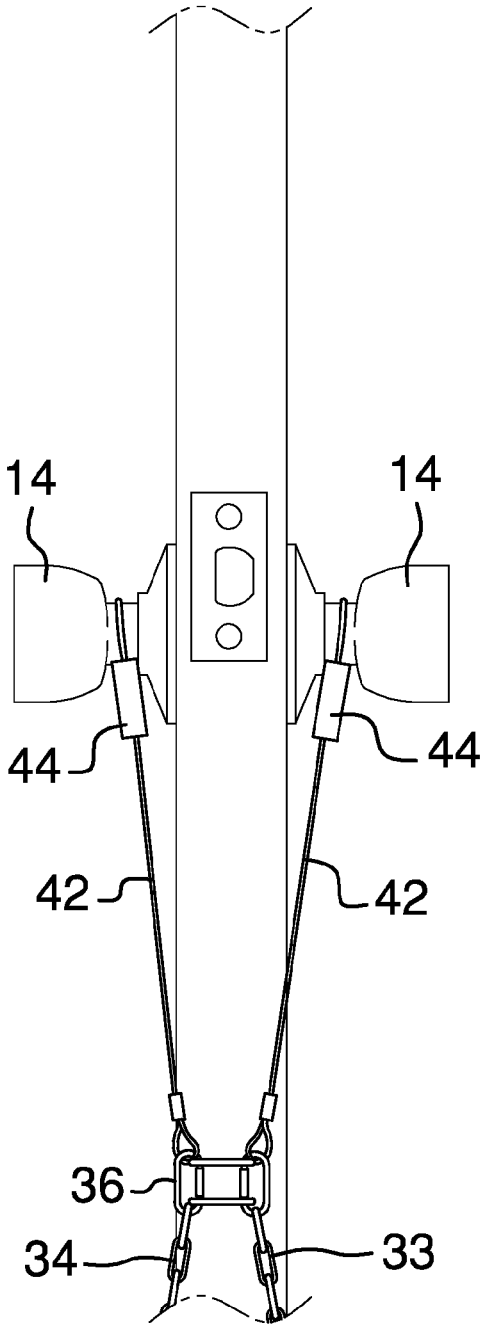
FIG. 6 is a lateral elevation view of the cables hooked to existing doorknobs.

Referring to FIG. 6, the pair of identical coated cables 42 is removably affixed to the junction box 36. A sliding cinch 44 is disposed on each coated cable 42. The coated cables 42 prevent damage to objects such as the doorknobs 14. The sliding cinches 44 adjust the coated cables 42 to prevent inadvertent detachment.

Figure 5:
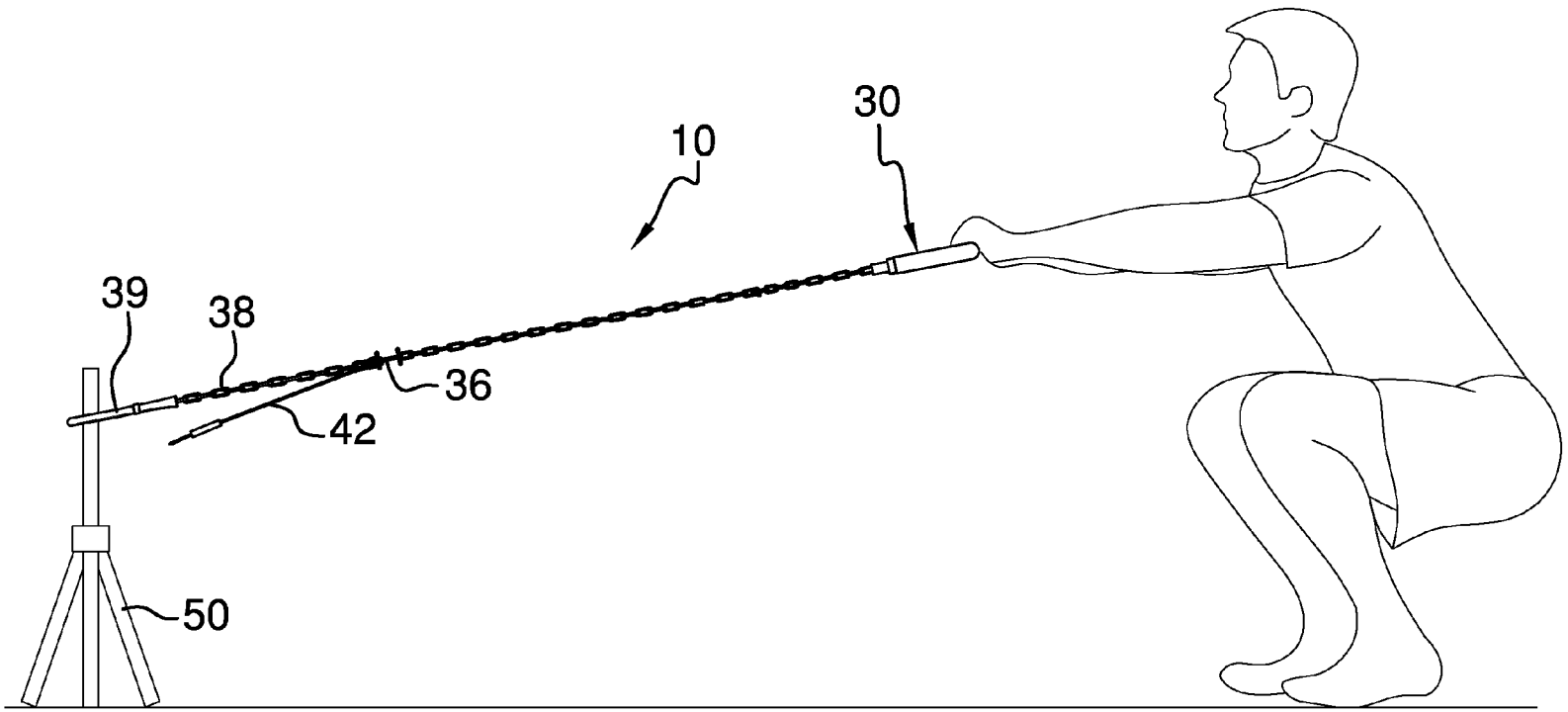
FIG. 5 is an in-use view using the tripod.

Referring to FIG. 5, the portable tripod with pole 50 removably receives the chain loop 38. The tripod with pole 50 is height adjustable. The tripod with pole 50 may be equipped with downwardly projecting stakes (not shown) for anchoring the tripod with pole 50 in a ground surface.

Figure 7:
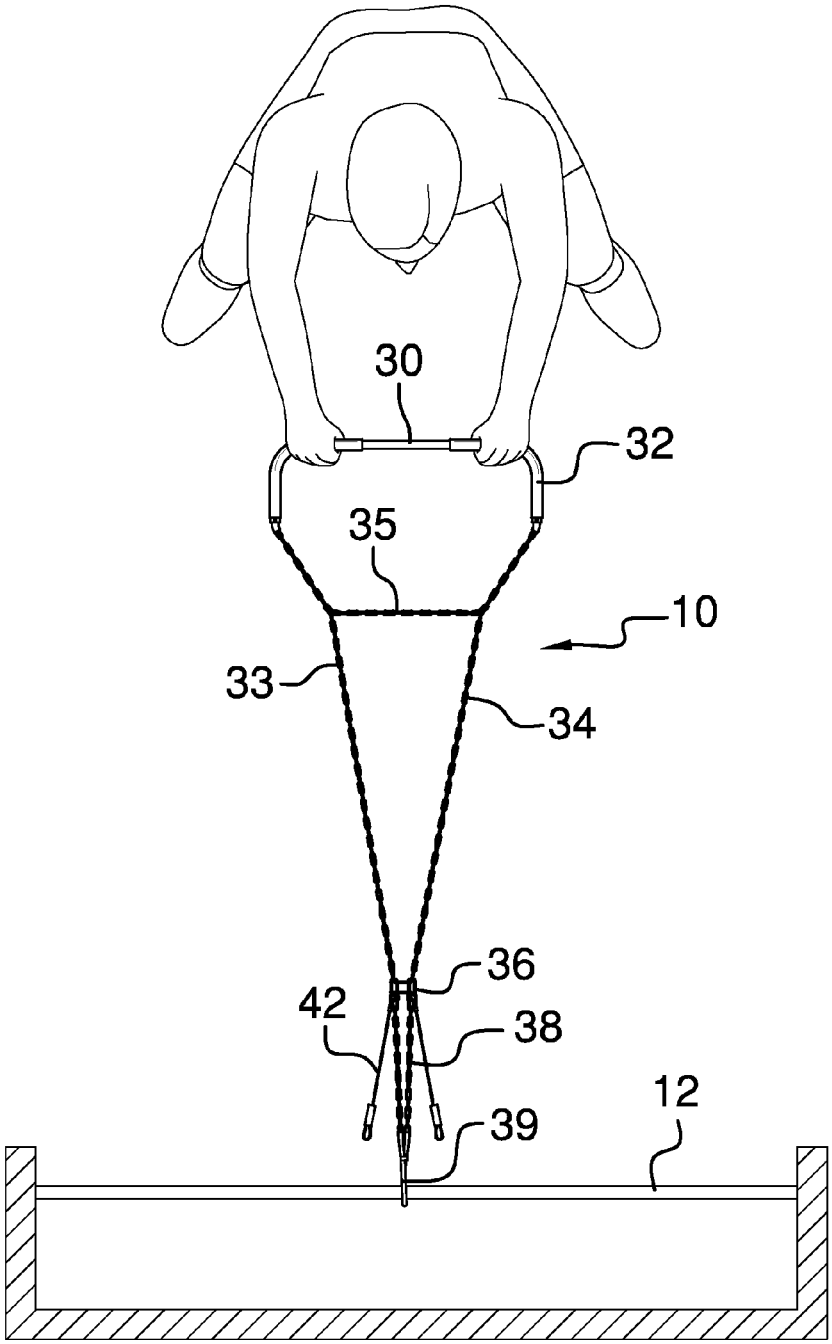
FIG. 7 is a top plan in-use view.

Referring to FIG. 7, the user has put an anchorable existing pole through the chain loop 38.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the flexible attachable exercise device may be used.

What is claimed is:

1. A flexible attachable exercise device comprising, in combination:

a u-shaped handle with rubber grip disposed at a first end;

a first chain extended from a one side of a pair of opposite sides of the u-shaped handle;

a second chain extended from a second side of the pair of opposite sides of the u-shaped handle;

a separable junction box connecting the first chain to the second chain at a second end;

a chain loop hooked to the junction box;

a rubberized cover disposed on the chain loop a cinch slideably binding the chain loop;

a pair of identical coated cables affixed to the junction box;

a sliding cinch disposed on each coated cable.

2. The device according to claim 1 further comprising a cross link connecting the first chain to the second chain proximal to the u-shaped handle.

3. A flexible attachable exercise device comprising, in combination:

a u-shaped handle with rubber grip disposed at a first end;

a first chain extended from a one side of a pair of opposite sides of the u-shaped handle;

a second chain extended from a second side of the pair of opposite sides of the u-shaped handle;

a cross link connecting the first chain to the second chain proximal to the u-shaped handle;

a separable junction box connecting the first chain to the second chain at a second end;

a chain loop removably hooked to the junction box via removable links;

a rubberized cover disposed on the chain loop a cinch slideably binding the chain loop;

a pair of identical coated cables removably affixed to the junction box;

a sliding cinch disposed on each coated cable.

4. A flexible attachable exercise device comprising, in combination:

a u-shaped handle with rubber grip disposed at a first end;

a first chain extended from a one side of a pair of opposite sides of the u-shaped handle;

a second chain extended from a second side of the pair of opposite sides of the u-shaped handle;

a cross link connecting the first chain to the second chain proximal to the u-shaped handle;

a separable junction box connecting the first chain to the second chain at a second end;

a chain loop removably hooked to the junction box via removable links;

a rubberized cover disposed on the chain loop a cinch slideably binding the chain loop;

a pair of identical coated cables removably affixed to the junction box;

a sliding cinch disposed on each coated cable;

a portable tripod removably receiving the chain loop.

* * * * *